US008689756B2

(12) United States Patent
Dauster et al.

(10) Patent No.: US 8,689,756 B2
(45) Date of Patent: Apr. 8, 2014

(54) METHOD FOR GENERATING AND APPLYING A CLEANING VOLTAGE PULSE TO A STOP CONNECTION, AND AN ASSOCIATED DIGITALLY CONTROLLED MAGNETIC IGNITION CIRCUIT

(75) Inventors: Holger Dauster, Oberasbach (DE); Leo Kiessling, Cadolzburg (DE)

(73) Assignee: Prufrex Engineering E Motion GmbH & Co. KG, Cadolzburg (DE)

( * ) Notice: Subject to any disclaimer, the term of this patent is extended or adjusted under 35 U.S.C. 154(b) by 795 days.

(21) Appl. No.: 12/956,286

(22) Filed: Nov. 30, 2010

(65) Prior Publication Data

US 2011/0162615 A1 Jul. 7, 2011

(30) Foreign Application Priority Data

Dec. 1, 2009 (EP) ..... 09177619

(51) Int. Cl.

| | |
|---|---|
| ***F02P 11/00*** | (2006.01) |
| ***H01H 47/22*** | (2006.01) |
| *F02D 17/00* | (2006.01) |
| *F02P 3/08* | (2006.01) |
| *H05B 41/14* | (2006.01) |

(52) U.S. Cl.
USPC ..... 123/143 R

(58) Field of Classification Search
USPC ..... 123/143 R, 149 A, 149 R, 6.56, 198 DC, 123/598, 599, 600, 601, 630, 632, 406.64; 361/265, 139
See application file for complete search history.

(56) References Cited

U.S. PATENT DOCUMENTS

| | | | | |
|---|---|---|---|---|
| 4,610,237 | A | 9/1986 | Ionescu et al. | |
| 4,697,570 | A | 10/1987 | Ionescu et al. | |
| 4,976,234 | A | 12/1990 | Okuda | |
| 5,646,461 | A * | 7/1997 | Kubota | 307/116 |
| 5,730,098 | A * | 3/1998 | Sasaki et al. | 123/198 DC |
| 8,161,942 | B2 * | 4/2012 | Lei et al. | 123/198 DC |
| 8,161,943 | B2 * | 4/2012 | Iwata et al. | 123/198 DC |
| 2008/0252219 | A1 | 10/2008 | Lei et al. | |

FOREIGN PATENT DOCUMENTS

| | | |
|---|---|---|
| DE | 200 14 502 U1 | 1/2001 |
| DE | 10 2004 059 070 A1 | 2/2006 |

* cited by examiner

*Primary Examiner* — Hieu T Vo
(74) *Attorney, Agent, or Firm* — Frank H. Foster; Kremblas & Foster

(57) ABSTRACT

A method for generating and applying at least one voltage pulse, which provides a cleaning effect for a stop switch, to a stop connection assigned to the stop switch, which stop connection is provided on a digitally controlled magnetic ignition circuit of an electrical device, wherein the magnetic ignition circuit generates a voltage wave series from half waves, the amplitude of which decreases over time, and/or at least one voltage pulse in a medium voltage range, wherein if a voltage wave series is generated, at least one later half wave in the voltage wave series, which half wave follows the first half wave temporally and therefore has a lower amplitude, is applied as a voltage pulse to the stop connection, and/or in that if at least one voltage pulse in a medium voltage range of 12 V to 50 V is generated, the one or more voltage pulses are applied to the stop connection and thereby exert a cleaning effect on the stop switch.

16 Claims, 11 Drawing Sheets

METHOD FOR GENERATING AND APPLYING A CLEANING VOLTAGE PULSE TO A STOP CONNECTION, AND AN ASSOCIATED DIGITALLY CONTROLLED MAGNETIC IGNITION CIRCUIT

BACKGROUND OF THE INVENTION

The invention relates to a method for generating and applying/conducting at least one voltage pulse, which provides a cleaning effect for a stop switch, to a stop connection assigned to said stop switch, which stop connection is provided on a digitally controlled magnetic ignition circuit of an electrical device, wherein the magnetic ignition circuit generates a voltage wave series from half waves, the amplitude of which decreases over time, and/or generates at least one voltage pulse in a medium voltage range. The invention further relates to a digitally actuated/controlled or actuable magnetic ignition circuit of an electrical device, said circuit comprising a stop connection assigned to a stop switch, wherein the magnetic ignition circuit is embodied for generating and applying/conducting at least one voltage pulse, which provides a cleaning effect for the stop switch, to the stop connection, and wherein the magnetic ignition circuit is embodied for generating a voltage wave series from half waves, the amplitude of which decreases over time, and/or for generating at least one voltage pulse in a medium voltage range.

Many electrical devices or machines contain stop switches that are provided with contacts or contact surfaces; one problem with such contacts or contact surfaces is that they can become contaminated, for example, oxide layers can form on the switch contacts. It therefore makes sense for the switch contacts or switch contact surfaces to be cleaned regularly or occasionally, by at least removing the thin oxide layers, so as to ensure the proper functioning of the stop switch. With many other contaminants, cleaning by deposit burning off, for example, is unfortunately not yet an option.

The prior art contains various approaches for cleaning such switches. For example, it is known to clean switches using sliding contacts. In such processes, sliding switches are used for self-cleaning the contact surfaces. When the switch is activated, one contact slides over the other, with this sliding movement removing contaminants of all types from the contact surfaces. This is intended to ensure a reliable contacting of the contact surfaces. The contact surfaces are scrubbed clean each time the switch is activated.

Another concept involves switch cleaning using high-voltage pulses. In this case, the contact surfaces on the two switch surfaces are cleaned using high-voltage pulses. The high-voltage pulses are a byproduct of a high-voltage stop. With this type of stop, the charging coil of an ignition circuit in the electrical device is short-circuited. This prevents an ignition capacitor, which is also provided in the ignition circuit, from charging. It is therefore impossible to generate an ignition spark. With the method of the high-voltage stop, a very high pulsed voltage is applied to the stop connection. If the stop contact is touched, an electric shock can occur. As a result, the stop circuit must be insulated through costly methods and means. Nevertheless, because of the high voltage, the switch contacts are self-cleaned whenever the stop switch is pressed. A device of this type is known, for example, from DE 10 2004 059 070 A1. The peak voltages generated in this case lie at around 250 V.

Older analog ignition circuits frequently have a separate coil for stopping. In such cases, when the stop switch is pressed voltage no longer builds up at an ignition capacitor of the analog circuit, and the igniter will no longer spark. This is achieved by positioning the charging coil and the breaker coil in the same alignment on a metal core. As a result, the voltage is cophasal, and whenever the charging coil is to be charged, said voltage passes through a thyristor, correspondingly provided in the circuit. The voltage occurring at the shut-off coil results in a medium voltage at the stop connection.

One problem with this method, however, is that the last spark is generated at an uncontrollable time, and therefore the probability of a misfire is very high.

With digital ignition circuits, rather than an analog igniter, an igniter controlled by a microcontroller is used. For this purpose, in addition to the above-described high-voltage stop, the concept of the low-voltage stop is available, however, the low-voltage stop, in which voltage pulses in the voltage supply range of digital control or below are used, exerts no cleaning effect on the switching contacts of the stop switch. This method does not involve any self-cleaning of the contacts.

U.S. Pat. No. 4,976,234 A, U.S. Pat. No. 4,697,570 A, US 2008/252219 A1, U.S. Pat. No. 4,610,237 A and DE 200 14 502 U1 disclose stop switches for internal combustion engines and/or ignition systems. Devices for switch cleaning are not described.

Therefore, the problem addressed by the invention is that of specifying a method that is improved in this respect or a digitally controlled or controllable magnetic ignition circuit that is improved in this respect.

SUMMARY AND EXPLANATION OF THE INVENTION

To solve this problem, a method for generating and conducting at least one voltage pulse, which provides a cleaning effect for a stop switch, to a stop connection assigned to said stop switch is provided, wherein the stop connection is provided on or in a digitally controlled magnetic ignition circuit of an electrical device, and wherein the digitally controlled magnetic ignition circuit generates a (at least one) voltage wave series from half waves, the amplitude of which decreases over time, and/or generates at least one voltage pulse in a medium voltage range of 12 V to 50 V, wherein the method is characterized in that with a voltage wave series having a temporally decreasing amplitude, at least one later half wave in the voltage wave series, which half wave follows the first half wave in time and therefore has a lower amplitude, is conducted to or applied to the stop connection, thereby exerting a cleaning effect on the stop switch, and/or in that with the generation of at least one voltage pulse within a medium voltage range, the one or more voltage pulses are conducted to or applied to the stop connection, thereby exerting a cleaning effect on the stop switch. The magnetic ignition circuit can also generate a voltage wave series or a voltage pulse series, and is characterized in that the voltage wave series or voltage pulse series is subjected to filtering, such that only certain half waves or pulses, for example, only positive or only negative half waves or pulses, are conducted or applied to the stop connection, thereby exerting a cleaning effect on the stop switch. Said voltage wave series or voltage pulse series then can also have a constant or even an increasing amplitude or pulse height assuming it is suitably filtered, or assuming that after filtering, the amount of voltage can be adjusted, for example, by means of a resistor.

The method is, of course, suitable not only for cleaning stop connections in ignition circuits, and is instead suitable for general use in circuits. In the method according to the invention for switch cleaning in digital magnetic ignition systems, the drawbacks related to cleaning in the known low-voltage stop and the high-voltage stop for igniters are overcome. According to the invention, a voltage is applied to the stop connection, for example, said voltage lying within a medium voltage range, with the pulses thereof being suitable for destroying an oxide layer on the contacts, thereby effecting a self-cleaning of the contacts. Alternatively or additionally, with a voltage wave series having a decreasing amplitude, the method can be implemented such that at least the first voltage pulse, which has a very high or a higher amplitude, is not yet conducted or applied to the stop connection. In contrast to a short circuiting of the charging coil with a high-voltage stop, in which even the first very high voltage pulses are present at the stop connection following the short circuit, this method offers the advantage that costly insulation is not necessary for the switch cleaning provided according to the invention. In both cases, the switching contacts can be cleaned of contaminants. The term "switch" within the context of the present invention is understood as having a broad meaning, and also includes push-buttons, etc. The concept of "conducting" the voltage is used within the context of this application for a simpler wording in the sense that the corresponding voltage wave series or voltage pulses generated in the circuit are applied to the stop connection. The voltage pulses can take on the widest range of forms. Waveforms are possible, along with rectangular pulses and other pulse forms as well.

A pulsed voltage is therefore applied according to the invention to the stop connection, wherein said voltage is generated in an advantageous manner by means of a circuit inside the device, in other words, for example, as an ignition voltage or some other voltage wave series that is otherwise necessary to the operation of the device. The multiple or individual voltage pulses for cleaning the stop connection can be applied at regular intervals to the stop connection. The voltage, optionally with its smaller pulses, which must still be sufficient to enable self-cleaning of the switching contacts, is applied or conducted to the switch connection in order to break through layers of oxidation there and to guarantee a clean contact between the switching surfaces of a stop switch. Alternatively or additionally, a medium voltage series or a medium voltage pulse, which is generated in a circuit inside the device (anyway, or specifically for this purpose), can be used directly to apply said series/pulse to the stop switch. Usually, individual voltage pulses are generated. If the voltage is generated by means of ignition capacitors, a decreasing voltage wave is generated. One particular advantage of a medium voltage pulse which is derived according to the invention from an already existing pulse-type internal voltage is that no (separate) switching elements are required. With a magnetic ignition system with digital control according to the invention, which control is ordinarily implemented via a microcontroller, but can also be implemented through other means, the status of the stop switch is preferably tested or detected by the digital controller by means of a voltage signal from the digital controller (from the microcontroller). Thus it is determined whether the stop switch is open or closed. In addition, a medium voltage deposit burning off pulse (in the ignition module) is coupled into this signal path, to particular advantage, for the purpose of self-cleaning the stop contact.

The term "medium voltage range" within the context of the invention means that the voltage lies within a range in which a self-cleaning of the connection contacts is possible, in other words, in which the voltage is high enough to remove contaminants or destroy an oxide layer. On the other hand, however, the voltage in this range is not so high that touching the contacts carries with it the risk of electric shock. According to the current state of the art, medium voltage is considered primarily to range from about 12 V to about 50 V peak voltage. With a high-voltage stop, in contrast, peak voltages of 250 V and effective voltages of 50 V are reached, which when contacted lead to clearly perceptible electric shocks. Therefore, with a manually operated machine, in the event of a shock there is a risk that the operator might "tear out" the machine out of fear or pain. In contrast, the effective voltage with a medium voltage stop is barely perceived or noticed, especially with the ordinarily short pulse lengths.

In tests involving ignition circuits, it has been demonstrated that a voltage of only about 15 volts is sufficient to break through thin oxide layers. Moreover, it is known from EP 0 866 480 A2 that even relatively low voltages produce a cleaning effect on contact points.

As was mentioned above, the circuit, as an ignition circuit, can generate an ignition voltage wave series and/or at least one ignition voltage pulse, and/or as a voltage wave series with a temporally decreasing amplitude, can generate a voltage wave series coming from a high voltage or higher voltage, wherein pulses or half waves of the ignition voltage are used for switch cleaning, or an ignition spark can be shut off as needed by means of the stop connection. Of course, the switch can also be cleaned by means of voltage pulses which are generated in the magnetic ignition circuit as extra pulses for the purpose of switch cleaning or for purposes other than for the ignition process itself.

If the waves of an ignition voltage wave series are used to remove contaminants from the stop switch or the stop connection according to the invention, this has the advantage that the cleaning pulse has a fixed position or occurs at a known, established point in time. Cleaning therefore always occurs at a defined time, or occurs based upon the time at which the ignition spark is generated. In addition to the cleaning effect, the stop connection naturally serves a stop function, for example, for shutting off or preventing an ignition spark. In particular, a medium voltage stop can be realized in this manner.

According to the invention, every other half wave of the voltage wave series and/or only medium voltage pulses and/or half waves of the voltage wave series that do not produce an electric shock and/or voltage pulses that do not produce an electric shock can be conducted to the stop connection, and/or at least one half wave conducted to the stop connection and/or at least one applied voltage pulse can exert a cleaning effect on the stop connection in which an undesirable (thin) oxide layer is broken through and/or destroyed.

If only the later half waves, more particularly, based upon the incorporation of suitable circuit components, only the evenly numbered half waves, are conducted to the stop connection, then the primary pulse, which can be higher than a medium voltage, is available for a (different) function internal to the device, for example, for ignition sparks. In this case, the second, fourth, sixth, etc. half waves can then be used to burn off the stop switch. Burning off then takes place only during sparking. Conducting only specific or later half waves or pulses to the stop connection results in the advantage that only a limited portion of the overall energy is used for destroying the oxide layer or to burn off the stop connection.

A component, particularly a diode, which conducts current in only one direction, can be situated upstream of the stop connection in such a way that only certain half waves and/or voltage pulses are applied or conducted to the stop connection. In the case of an ignition circuit, the diode can ensure, for example, that only positive half waves or positive voltage pulses are conducted to the stop connection. The negative half waves are available for ignition sparking, and therefore the energy used for burning off is limited.

The voltage of the at least one half wave and/or of the at least one voltage pulse conducted to the stop connection can be adjusted by means of a resistor, or optionally multiple resistors, situated upstream of the stop connection. For example, a resistor, optionally an adjustable resistor, can be provided between the diode or one or more other components which conduct current in only one direction and the stop connection, wherein said resistor makes it possible to adjust or modify the strength of the burning off pulse or the multiple burning off pulses for the stop connection up to a certain point (free), such that a voltage that is particularly suitable for burning off or destroying the oxide layer is applied to the stop connection.

Furthermore, according to the invention, the voltage at the stop connection can be limited by means of a voltage limiter. By limiting the voltage of the medium voltage stop according to the invention, it is possible to prevent the build-up of a voltage which is so high that it could result in electric shock. A protective element of this type can also be embodied as the protective circuit of a stop input. A capacitor which is situated upstream of the stop connection, and which must first be charged in the case of both an internal and an external voltage spike, can be used for this purpose. If the capacitor is not yet fully charged, it is a relatively low resistance component. Therefore, the capacitor is able to independently block lower voltage spikes. In addition to the capacitor, a Zener diode can be provided, which will itself function as a voltage limiter when the capacitor situated upstream of the stop connection is no longer sufficient to limit the voltage. The Zener diode is connected in parallel with the capacitor for this purpose. For the voltage limiting circuit, it must be ensured that the medium voltage pulse applied to the stop connection is embodied so as to be capable of fully charging the capacitor. If this were not the case, the voltage levels desirable or required at the stop connection could not be achieved. A capacitor situated upstream of the stop connection can further have a positive effect on the cleaning process according to the invention. More particularly, if an oxide layer is present on the stop switch, then the voltage at the capacitor will increase until the oxide layer is broken through and the flow of current begins. With this, the capacitor empties, thereby supporting the burning off process. Without the capacitor, the burning off process would be severely restricted. The capacitor provides low-resistance energy for cleaning the switch once the oxide layer has begun to yield or be broken through.

In addition, a protective circuit of at least one pin of a microcontroller that controls the digital circuit can be realized according to the invention. For example, with a medium voltage stop, the microcontroller can thereby be protected against excessively high voltages. Within this context, particularly in the case of a medium voltage stop, as an addition to or an alternative to the cleaning method described, self-protecting elements or hardware reach-throughs into the circuit can be implemented. In this manner, even a failure of an optionally provided decoupling resistor for the microcontroller can be counteracted, for example. A decoupling resistor of this type is regularly loaded by the medium voltage pulses. A failure is therefore conceivable, and safeguards against such an event should be provided as described.

According to the invention, the proper connection between a pin of a microcontroller which controls the circuit or is provided for the control thereof and the stop connection can be verified by means of a self-protecting structural design, especially with a capacitor at the stop connection and a resistor at the microcontroller.

Of course, it is also possible to implement a self-protecting structural design of this type independently of a medium voltage stop or of the generation and conduction of cleaning pulses for the stop connection. In other words, in this case a digital circuit is provided, in which the connection between the microcontroller pin or the plurality of microcontroller pins and the external connection is verified within the framework of self-protection. The self-protection is implemented, for example, by means of a capacitor, close to the external connection, and a resistor close to the controller. The resistor at the microcontroller can optionally be replaced by a pull-up resistor inside the microcontroller. The capacitor is connected on one side to the stop connection and on the other side to the ground.

The connection between resistor and capacitor can be verified in two phases or by means of two processes. For example, in the first phase the capacitor can be charged for a certain amount of time, and can then be read out by the microcontroller. In this case, the microcontroller should detect a high status if the connection is in the proper state. If a high is not detected by the microcontroller, either the external stop switch is pressed or, in the example of an ignition circuit, the igniter could have an internal connection to the ground. In either case, no ignition spark would be generated, and therefore, it is not important to differentiate these cases in detail.

However, if, as expected, the microcontroller detects a high status or level, the transition to the second phase or the second process occurs. The capacitor is discharged and then read in again. The microcontroller should then detect a low status. If, contrary to expectations, a low status is not detected, several errors could be responsible for this, for example, in the case of an ignition circuit described here, a disconnection between the resistor and an associated capacitor within the igniter, the absence of the capacitor, an end of the supply voltage, etc. Each of these error instances result in a shut-off of the ignition spark, and therefore further differentiation is unnecessary.

With the self-protecting circuit arrangement, the pull-up resistor which can be provided in the microcontroller can serve, according to the invention, to detect the absence of the capacitor. Specifically, the microcontroller input itself has a low capacity. If the capacitor is missing, the resistor will pull the input of the microcontroller to a high level. In the dimensioning of the pull-up resistor, it must be ensured that said resistor is embodied as relatively high-resistance, in order that the lowest possible energy loss will result. Moreover, the resistor of the digital circuit arrangement should be expediently embodied such that the capacitor is not charged too rapidly at the stop connection.

Furthermore, the self-protecting digital circuit arrangement for the flexible detection of high- and low states can have a microcontroller pin with an analog/digital converter and/or with a comparator or a comparator function. Therefore, the adjustable threshold is flexible and can be used to compensate for effects such as parallel resistance.

Within the scope of the invention, stop switch sensing for the stop connection can function as described above in connection with the self-protecting structural design for phase 1 of protecting the connection paths. It is therefore possible to combine the two functions of stop switch sensing and phase 1 of protecting the connection paths. The stop switch sensing is then a part of the protection.

With an ignition circuit, a hardware reach-through, particularly realized by means of one or more diodes, can be used to ensure that when the stop switch is connected, no ignition spark will be generated, independently of the actuation of the ignition circuit by a microcontroller.

The hardware reach-through therefore prevents the generation of a spark, even when the microcontroller would or intended to generate a spark. Of course, a hardware reach-through of this type, like the self-protecting structural design, can optionally be implemented independently of a medium voltage stop or a cleaning of the stop connection. In this case, therefore, a digital circuit arrangement is only generally provided with a microcontroller, which is embodied as an ignition circuit and in which a hardware reach-through is implemented such that when the stop switch is connected or when a stop push-button is pressed, etc., no ignition spark is generated. Therefore, when the stop switch is connected, a generation of the ignition spark can be directly or indirectly prevented, bypassing the digital circuit, when a hardware reach-through is provided in the output part of the magnetic ignition system.

A hardware reach-through of this type according to the invention can be achieved, for example, by means of additional diodes (depending upon the type of circuit, two) in the circuit. If the stop switch is not activated or pressed, a thyristor is connected through, for example, by a high level of an ignition output, thereby generating an ignition spark. If, on the other hand, the stop switch is activated, the stop connection is connected to the ground. By means of a first diode, no voltage greater than about 0.7 volts, for example, can occur between a resistor situated upstream of the ignition pin of the microcontroller and a diode downstream which conducts current to the stop connection (naturally, other voltages of other magnitudes are also conceivable, depending upon the concrete embodiment of the circuit). Via a diode situated downstream of the resistor in the direction of the thyristor, a corresponding voltage is lost, so that no voltage builds up at the gate input of the subsequent thyristor, and never connects said thyristor through, and therefore no ignition spark can be generated when the stop switch is activated. Therefore, the invention also relates generally to a method of this type for hardware reach-through.

The voltage wave series and/or the at least one voltage pulse can be generated by a coil, or optionally a combination of multiple coil-like components, particularly by a coil with an iron core and/or a coil penetrated by a magnetic field of a magnetic flywheel and/or the primary side of an ignition coil. In other words, it is possible, in principle, to generate, by different methods and means, a pulsed voltage and/or voltage waves or individual voltage pulses for cleaning a stop connection, or to derive said voltage or voltage waves or voltage pulses from a circuit internal to the device (already present). The pulsed voltage can be obtained, for example, from a coil, which may be a coil with an iron core, which is penetrated, for example, by the magnetic field of a magnetic flywheel of an electric machine. For the present case involving digital ignition circuits, it is expedient to draw the pulse-form voltage from the primary side of the ignition coil. A separate coil then is not necessary for burning off the stop connection, and therefore the space required for such additional components is saved, to particular advantage. Thus according to the invention, an existing coil, for example a coil penetrated by the magnetic flywheel force and having a corresponding voltage amplitude, is preferably used as the voltage source for the medium voltage pulse. The coil can also be the primary coil of the ignition transmitter, which need not necessarily rest on a metal core penetrated by the magnetic field. In addition to its customary function, said coil then also functions as the voltage source that generates the wave-form voltage which, optionally weakened via a diode or a resistor, will be conducted to the stop connection. The medium voltage pulse or burning off pulse, which originates from a voltage pulse present in the ignition module, or which is used as the one existing voltage pulse, has the advantage that no additional switch is required for generating a pulse from a voltage. A burning off pulse is used so that current will not flow continuously (no continuous operating voltage is present).

The pulse-form voltage required to burn off the switching contacts can be generated by means of a coil, which is wound onto the metal core of an igniter and through which the magnetic field of the magnetic flywheel flows. In this case, as mentioned, a separate coil can be dispensed with. However, it is also within the scope of the invention to use a separate coil, additionally provided in the circuit for the purpose of obtaining a pulse-form voltage (for connection cleaning or for the medium voltage stop), rather than using a coil already existing in the circuit. In an embodiment having a combined coil (which already fulfills a function in the original circuit and additionally generates the cleaning pulses) it is not necessary to use the (ignition) charging coil as the source for the pulses. In principle, any coil that can generate a voltage of the necessary intensity is suitable. With an additional coil in the switching circuit, for example, a medium voltage coil is also arranged on the metal core or iron core, for example, in addition to the charging coil.

In addition to the coil, a capacitor, particularly an ignition capacitor, for forming an oscillating circuit is or can be arranged in the circuit, wherein optionally a component, particularly a diode, which conducts current in only one direction, and/or a switch that produces a connection with the ground, which within the context of the invention can quite generally be an electronic switching element, are situated upstream of the capacitor for the purpose of charging by means of a voltage source. The capacitor, particularly an ignition capacitor, can thus be charged via a voltage source of the circuit and a diode optionally situated downstream thereof. When the capacitor is then charged, and, in the case of an ignition circuit, when the time is proper for generating an ignition spark, then the switch or the switching element, also situated upstream of the capacitor, which switch or switching element connects the one side of the capacitor to the ground, is rendered conductive. Thus the primary coil of the ignition circuit, which is connected via a circuit to the capacitor, is supplied with current.

Because the positively charged side of the capacitor is grounded by the switching process, the other side is correspondingly negative. The diode or other component which conducts current in only one direction, situated upstream of the stop connection, then prevents a flow of current from the stop connection in the direction of the ignition capacitor. The ignition capacitor discharges, the magnetic field collapses and induces a voltage, which is reversed in its polarity. This voltage then re-charges the capacitor, and is also further conducted to or applied to the stop connection, enabled by the single-side conductive diode. In this manner, the primary pulse can be used solely for sparking ignition or, with another pulse voltage internal to the device, for another purpose provided for the circuit, whereas the second, fourth, sixth, etc. half waves are used to burn off the stop switch. In an ignition circuit, this has the advantage that the stop connection is cleaned only during sparking, and additionally, only a limited portion of the total available energy is used for this purpose.

A stop event assigned to the stop connection can be evaluated and/or sensed, independently of the at least one half wave conducted to the stop connection, particularly for enabling a controlled shut-off of the electrical device, and/or a shut-off without misfiring of the electrical device, and/or during the time not used for cleaning, at least one additional function, particularly a communication function, can be assigned to the stop connection.

For example, if, in principle, the second half wave and optionally additional, higher half waves of the voltage wave are used to eliminate contaminants, then the cleaning pulse will have a fixed temporal sequencing. In the case of an ignition circuit, this means that cleaning is always coupled with the generation of the ignition spark. It is therefore possible to assign other functions to the stop connection during the remaining time. For example, a stop switch sensing can be carried out, optionally via corresponding means for determining status or for conducting signals. Corresponding functions can be implemented in a microcontroller. Communication can also be implemented via the same line as that of the stop connection. A communication of this type could function as described in US 2008/02662706 A1, for example, or in a manner similar thereto. For the implementation of additional functions at the stop connection and the corresponding signal transmission functions, however, it must be ensured that the circuits that are connected thereto are protected against the expected voltage pulse or voltage pulses.

Various solutions for sensing the position of the stop switch are conceivable. Within the scope of the invention, it is expedient to combine sensing the stop switch with the application of the one or more medium voltage pulses to the stop switch. The medium voltage pulse then serves simultaneously as stop switch sensor and/or for evaluating the stop switch status. This can be carried out, for example, by the digital controller of the magnetic ignition system measuring the voltage at the stop switch during the medium voltage pulse. If a certain level or a voltage value predetermined for controlling a voltage comparison is exceeded, then the stop switch is opened. If the voltage drops below such level, or if the predetermined voltage level is not reached, then the stop switch is closed. A separate switch sensing pulse is not necessary.

The invention further relates to a digitally actuated/controlled or controllable magnetic ignition circuit of an electrical device, said circuit comprising a stop connection assigned to a stop switch, wherein the digital magnetic ignition circuit is embodied for generating and conducting at least one voltage pulse, which exerts a cleaning effect on the stop switch, to the stop connection, particularly according to a method as described above, and wherein the magnetic ignition circuit is embodied for generating a voltage wave series from half waves, the amplitude of which decreases over time, and/or for generating at least one voltage pulse in a medium voltage range of 12 V to 50 V. This digitally controlled ignition circuit is characterized according to the invention in that it is embodied, with a voltage wave series having a temporally decreasing amplitude, for conducting at least one later half wave in the voltage wave series, which half wave follows the first half wave in time and therefore has a lower amplitude, as a voltage pulse, which exerts a cleaning effect, to the stop connection, and/or in that, with the generation of at least one voltage pulse in a medium voltage range, the ignition circuit is embodied for conducting the voltage pulse or pulses to the stop connection, thereby producing a cleaning effect on the stop switch.

The invention further relates to a manually operated internal combustion engine with a digitally actuated/controlled or controllable magnetic ignition circuit or with a magnetic ignition system of this type, to be specified in greater detail in what follows. In this case, therefore, the electrical device is a device with an internal combustion engine provided for manual operation. The manually operated device with the internal combustion engine is provided with a digitally controlled magnetic ignition circuit, and is particularly embodied for carrying out a method as described above. The device or the magnetic ignition circuit has a stop connection assigned to a stop switch, wherein the magnetic ignition circuit is embodied for generating and applying at least one voltage pulse having a cleaning effect for the stop switch to the stop connection, and wherein the magnetic ignition circuit is embodied for generating a voltage wave series from half waves, the amplitude of which decreases over time, and/or for generating at least one voltage pulse in a medium voltage range. In the case of a voltage wave series having a temporally decreasing amplitude, the magnetic ignition circuit is embodied for applying at least one later half wave in the voltage wave series, which half wave follows the first half wave in time and therefore has a lower amplitude, as a voltage pulse to the stop connection, and/or in that with the generation of at least one voltage pulse within a medium voltage range, the magnetic ignition circuit is embodied for applying the one or more voltage pulse(s) to the stop connection, whereby in each case a cleaning effect is produced on the stop switch.

By using the later half waves of a voltage wave series having half waves of decreasing voltage, or by using a voltage wave series or a pulse series with pulses which first lie within a medium, suitable voltage range, a stop connection, which is provided in the digitally controlled circuit, is thus cleaned. The digital circuit arrangement has components with which a pulse-form voltage internal to the device can be generated, which can be an ignition voltage or even another suitable voltage, for example. The pulse-form voltage that is used is a voltage internal to the device, which need not be additionally generated for the stop connection or exclusively for a cleaning function. No space for a suitable additional coil is necessary, as with analog igniters, in which cleaning is carried out by means of a medium voltage. Additional components of a complex nature also are not necessary. The manufacturing costs can thus be kept low. Depending upon the type of digitally controlled circuit or the voltage pulse generation carried out there, however, the connection of a diode or comparable components, optionally in combination with a resistor, upstream of the stop connection can be expedient or necessary, as mentioned above. The range of the medium voltage can comprise voltages from 12 V to a peak voltage of 50 V, according to the invention.

The magnetic ignition circuit can be embodied for generating an ignition voltage wave series and/or at least one ignition voltage pulse, and/or the magnetic ignition circuit can be embodied for generating a voltage wave series originating from a high voltage and having an amplitude that decreases over time.

Moreover, the magnetic ignition circuit can be embodied for conducting every other half wave in the voltage wave series and/or only medium voltage pulses and/or half waves in the voltage wave series that do not lead to an electric shock and/or voltage pulses that do not lead to an electric shock to the stop connection, and/or at least one half wave that has been conducted to the stop connection, and/or at least one voltage pulse that has been applied to the stop connection can be embodied for cleaning the stop connection by breaking through and/or destroying an undesirable oxide layer.

Therefore, the conducting of pulses that are not suitable for cleaning, for example pulses the voltage of which is too high, in which the danger of electric shock exists, can be prevented by using simple electronic components or by the interaction thereof, as in the case of the ignition circuit. For instance, the waves can be filtered according to their sign. In the simplest case, the voltage waves or voltage pulses are then subsequently filtered, based upon whether they are positive or negative. However, also within the scope of the invention is a targeted, active selection or filtering of specific voltage waves or specific half waves having a suitable amplitude, for example, via digital signal processing or by the implementation of specific selection and/or filter criteria, defined by marginal conditions or parameters, in the digital circuit.

A component, especially a diode, which conducts current in only one direction, can be connected upstream of the stop connection in such a way that only specific half waves and/or voltage pulses are applied to the stop connection. Moreover, a current outflow from the stop connection in the direction of other components of the circuit is optionally prevented in this manner. A resistor can be connected upstream of the stop connection, via which resistor the voltage of the at least one half wave conducted to the stop connection and/or of the at least one voltage pulse can be adjusted. The resistor serves to adjust and optionally match the strength of the conducted half wave or the half waves to be conducted, for which purpose the resistor can be embodied as replaceable or adjustable.

By means of a voltage limiter, particularly using at least one capacitor and/or at least one Zener diode, the voltage at the stop connection of the digitally controlled circuit can be limited, and/or the circuit can have a protective circuit of at least one pin or for at least one input of a microcontroller that controls the circuit. Based upon the elevated voltages in the switching circuit in the case of a medium voltage stop as compared with a low-voltage stop, it is expedient to implement an effective or improved protection of the microcontroller in the ignition circuit. In the case of an ignition circuit, any unintended ignition can be prevented by means of a hardware-implemented blocking of a thyristor; the microcontroller then can no longer accidentally ignite due to the hardware reach-through.

The proper connection between a pin of a microcontroller that controls the magnetic ignition circuit and the stop connection can be verified by means of a self-protecting structural design of the circuit, particularly with a capacitor at the stop connection and a resistor at the microcontroller.

Thus in the ignition circuit, a hardware reach-through, implemented by means of one diode, particularly by means of (two) diodes, ensures that when the stop switch is connected, independently of the actuation of the ignition circuit by a microcontroller, an ignition spark cannot be produced. Therefore, this represents the special case of a hardware reach-through for an ignition circuit as a digitally controlled circuit.

The magnetic ignition circuit can comprise a coil, particularly a coil with an iron core and/or a coil through which the magnetic field of a magnetic flywheel passes, and/or the primary side of an ignition coil, for generating the voltage wave series and/or for generating the at least one voltage pulse. Optionally, other electric or electronic components, with which a voltage series or voltage pulses can be generated for use inside the device, are provided in the ignition circuit. Parts of this voltage series are then conducted to the stop connection, where they perform a cleaning function. Thus the periodically present pulse of a coil of the magnetic igniter, for example, which coil is arranged on an iron core through which a temporary magnet of a magnetic flywheel flows, is used as a voltage pulse from the ignition system. Moreover, the periodically present pulse can be used as the voltage pulse from the ignition circuit, which pulse is present at the primary coil of the ignition transfer element (with a capacitor discharge ignition) or the ignition coil (with a magnetic transistor ignition). During each generated high-voltage pulse or ignition spark, a pulse or pulse series of up to several 100 V is present at the primary coil. If the voltage values of the existing pulses are too high for conduction to the stop connection, then the pulses for application to the stop connection are optionally suitable for weakening.

In addition to the coil, a capacitor, particularly an ignition capacitor, for forming a resonating circuit can be arranged in the circuit, wherein a component, particularly a diode, which conducts current in only one direction, and/or a switch that produces a connection with the ground, can optionally be connected upstream of the capacitor for charging by means of a voltage source.

A stop event assigned to the stop connection can be evaluable and/or detectable, independently of the at least one half wave conducted to the stop connection, or of the one or more voltage pulses, more particularly, said stop event can be evaluated and/or detected for the purpose of enabling a controlled shut-off and/or a shut-off without a faulty ignition of the electrical device, and/or during the time that is not used for cleaning, at least one additional function, particularly a communication function, can be assigned to the stop connection. Thus, according to the invention, the digitally controlled magnetic ignition circuit of the electrical device enables a controlled shut-off without a misfiring.

BRIEF DESCRIPTION OF THE SEVERAL VIEWS OF THE DRAWINGS

Additional advantages, features and details of the invention are described in reference to the following embodiment examples and the drawings. The drawings show.

DETAILED DESCRIPTION OF THE INVENTION

Figure 1:
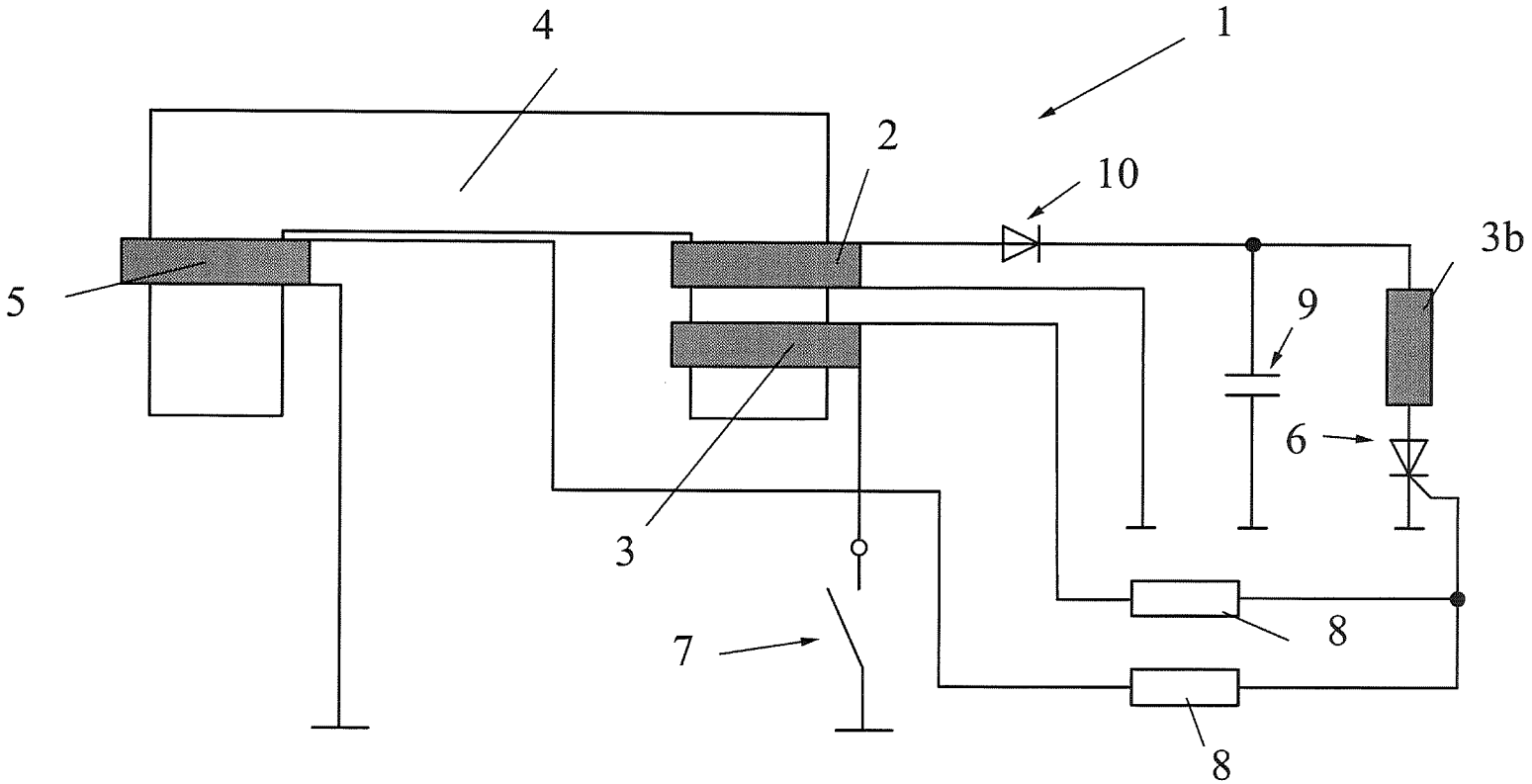
Fig. 1 PRIOR ART
FIG. 1 an analog switching circuit with switch cleaning according to the prior art, FIG. 2 a diagram outlining the principle of a digitally controlled circuit according to the invention, FIG. 3 a voltage wave series according to the invention on an ignition capacitor during the ignition spark, FIG. 4 a diagram outlining the principle of a further digitally controlled circuit according to the invention, FIG. 5 a diagram showing the voltage curves at three nodes of the circuit of FIG. 4, FIG. 6 a protective and limiting circuit according to the invention, FIG. 7 and FIG. 8 diagrams outlining the principle of generating medium voltage pulses by means of coils, FIG. 9 a self-protecting construction of a digital circuit according to the invention, FIG. 10 the phases of protecting the self-protecting structure according to FIG. 10 and FIG. 11 a diagram outlining the principle of a hardware reach-through according to the invention.

FIG. 1 shows an analog switching circuit 1 according to the prior art with switch cleaning. This analog switching circuit 1 is an ignition circuit and comprises a charging coil 2 and a breaker coil 3, which are arranged in the same orientation on a metal core 4. A trigger coil 5 is also provided. Because the charging coil 2 and the breaker coil 3 are positioned in the same orientation on the metal core 4, the phase position of the voltage is the same. As a result, whenever the charging coil 2 is being charged, the thyristor 6 of the analog switching circuit 1 is also passed through. The voltage produced at the breaker coil or the shut-off coil 3 leads to a medium voltage at a stop connection of the analog switching circuit according to the stop switch 7. Additional components in the analog switching circuit 1 are the resistors 8, the coil 3*b*, the capacitor 9 and the diode 10.

With this analog switching circuit 1, however, there is the problem that the last ignition spark occurs at an uncontrollable or unfixed time, therefore the probability of misfiring is relatively high.

Since the analog igniters have been largely replaced by igniters controlled by microcontrollers, only the two stop concepts involving the high voltage stop and the low voltage stop are still used for stopping. With the low voltage stop, the stop connection is not cleaned, whereas with the high voltage stop, there is the problem that contact with the stop contact can lead to an electric shock, and therefore costly insulation is necessary.

Figure 2:
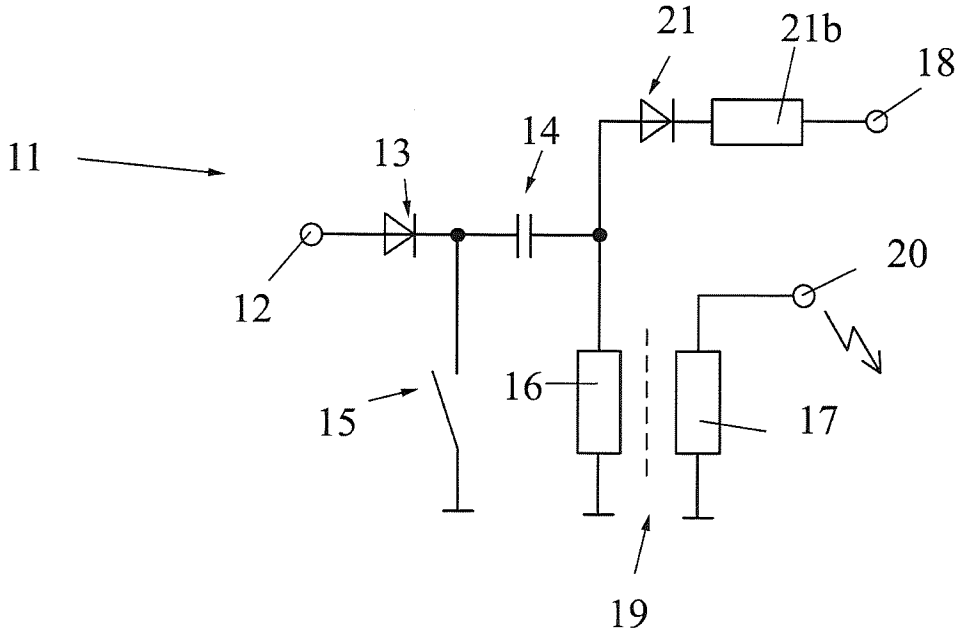

FIG. 2 shows a diagram outlining the principle of a digitally controlled magnetic ignition circuit 11 according to the invention. In this diagram, a voltage source 12 is provided, by means of which an ignition capacitor 14 is charged via a diode 13. A switch 15 or an electronic switching element is provided, connected upstream of the ignition capacitor 14, parallel with the diode 13. The switch 15 is connected when the capacitor is charged, and at the proper time for generating an ignition spark. The closest side, or the electrode of the capacitor connected to the switch 15 is connected to the ground by means of the switch 15. As a result, the primary coil 16 of the digital circuit 11 is supplied with current. Because the positively charged side of the capacitor 14 of the digitally controlled or controllable circuit 11 is grounded, the other side is negative. The diode 21 serves, as described in what follows, to conduct only certain half waves of an ignition pulse series to the stop connection 18.

Once the capacitor 14 has discharged, the magnetic field collapses and induces a voltage, which is rotated or reversed with respect to its polarity. This voltage charges the capacitor 14, and is conducted to the stop connection 18. In this method and manner, the primary pulse is used only for the ignition sparking of the ignition coil 19 with the primary coil 16 and the secondary coil 17. Therefore, a high voltage 20 is present on the secondary coil 17 side of the transformer of the ignition coil 19.

Only the second, fourth and sixth half waves of the ignition pulse series are used to burn off the stop switch or the stop connection 18. Burning off occurs only during the spark. Via the resistor 21*b*, the strength of the burning off pulse for the stop connection is freely adjustable up to a certain point. The circuits in the description of the figures are basic circuits or basic outlines. This means that in a concrete implementation, circuit design details are added or a number of components and elements can optionally be replaced by comparable components and elements.

Figure 3:
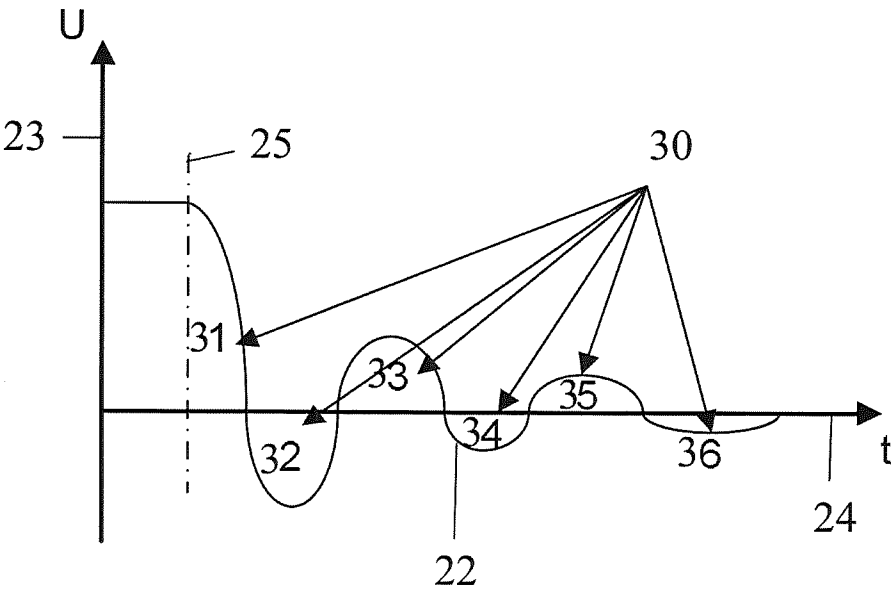

FIG. 3 shows a voltage wave series 22 according to the invention in an ignition capacitor, for example the capacitor 14, during the ignition spark. In the graphic illustration, the voltage is recorded on the vertical ordinate 23, and the time is recorded on the horizontal abscissa 24. The half waves of the voltage wave series 22 are identified by reference signs 31, 32, 33, . . . , 36. In this, the first half wave is identified by reference sign 31, the second half wave by 32, etc. The vertical line 25 indicates the start of the ignition spark.

The primary pulse or the first half wave 31 is used only for the ignition spark. Only the second, fourth, sixth, etc. half waves (half waves 32, 34, 36) are used for cleaning the stop connection. The cleaning pulses therefore have a temporally fixed position. In the remaining time, other functions can be assigned to the stop connection, for example, a switch position sensing or a communication on the same line.

Figure 4:
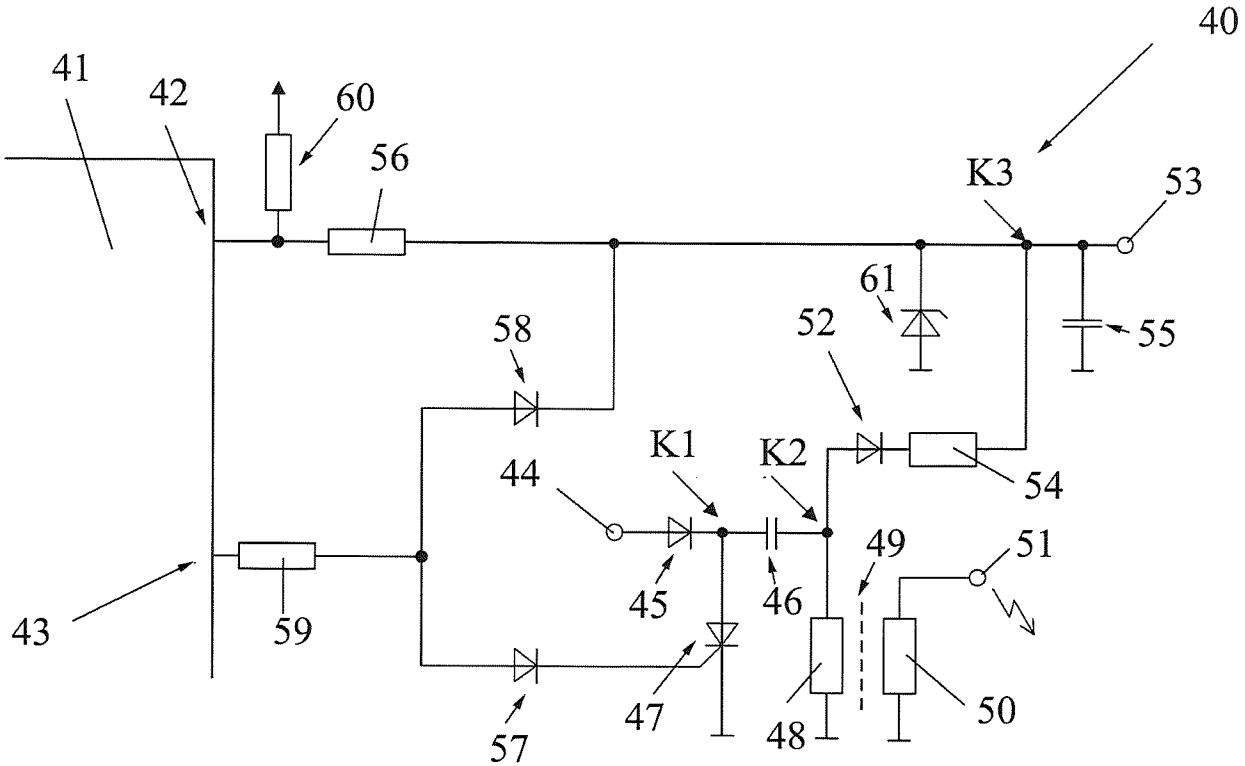

FIG. 4 shows a schematic representation of an additional digitally controlled magnetic ignition circuit 40 of the invention. The digitally controlled magnetic ignition circuit 40 is actuated/controlled by means of a microcontroller 41, which comprises a stop pin 42 on one side and an ignition output 43 on the other side. In a number of embodiments, the microcontroller 41 can be a component of the digitally controlled magnetic ignition circuit 40 according to the invention. By means of a voltage source 44, the ignition capacitor 46 is charged via the diode 45. When the ignition capacitor 46 is charged and the correct time has come to generate an ignition spark, then the thyristor 47 is switched on. Said thyristor connects node K1 or the corresponding side of the ignition capacitor 46 to the ground. Thus the ignition capacitor 46 lies quasi parallel with the primary coil 48 of the ignition coil arrangement 49 with the secondary coil 50.

The high voltage on the side of the secondary coil 50 of the ignition coil arrangement 49 is identified by 51. Because the positively charged side of the ignition capacitor 46 is grounded, the other side, which is assigned to the node K2, is negative. The diode 52 prevents a flow of current from the stop connection 53 in the direction of the ignition capacitor 46. Once the ignition capacitor 46 has discharged, the magnetic field collapses and induces a voltage that is rotated or reversed in terms of its polarity. Said voltage charges the ignition capacitor 46, and is also applied to the stop connection 53. On the basis of this procedure, the primary pulse is used only for the ignition spark. Only the later, evenly numbered half waves are used to burn off the stop switch or the stop connection 53. Said burning off is carried out only during the spark, so that only a limited amount of the energy is used for this purpose. The resistor 54 serves to adjust the strength of the burning off pulse for the stop switch or the stop connection 53. If an oxidation layer has formed on the stop switch, then the medium voltage pulse charges the capacitor 55, which is further provided in the circuit 40 (parallel with the stop connection 53, with one side grounded). The capacitor 55 therefore has a supportive effect for burning off and/or cleaning the stop switch. The node K3 of the digital circuit 40 is located between the node of the capacitor 55 and the Zener diode 61, as viewed from the resistor 54 in the direction of the stop connection 53. The cleaning pulse is generated at a fixed time, which is dependent upon the time of ignition. During the remaining time, additional functions can be assigned to the stop connection 53. In this, however, circuit components may optionally need to be protected from the expected voltage pulse or voltage wave series. The resistor 56 in the magnetic ignition circuit 40 is used for this purpose.

Furthermore, a hardware-side blocking of the thyristor 47 is implemented by means of diodes 57 and 58. If the stop connection 53 is connected to the ground by means of the stop switch not shown here, then the voltage at the gate connection of the ignition thyristor 48 can no longer increase to the point at which said thyristor would be triggered. An accidental ignition of the microcontroller 41 can thereby be excluded. Thus in connection with the medium voltage stop according to the invention with a self-cleaning function, the circuits or circuit components can also be protected. With a failure of the decoupling resistor 56, which is connected upstream of the stop pin 42 of the microcontroller 41, and which is regularly loaded by the medium voltage pulses, it can be ensured by means of a self-protecting structural design, for example, that no further ignition sparks will be generated. If a stop is not detected by the microcontroller 41, a hardware reach-through engages. However, this case is considered to be less probable.

The line between the stop pin 42 of the microcontroller 41 is monitored by means of a self-protecting structural design. Of course, both the hardware reach-through and the self-protecting design can be implemented in suitable circuits independently of a medium voltage stop or the connection cleaning, and can thus optionally be the subject matter of additional applications or partial applications for protection.

For the self-protecting structural design, the capacitor 55 must be positioned as close as possible to the stop connection 53. On the other side, the resistor 60 can be positioned close to the microcontroller pin, in this case the stop pin 42. A charging/discharging process ensures that the line between the microcontroller 41 and the stop connection 53 will not be interrupted, and a permanent high or low level will be present on this line.

Figure 5:
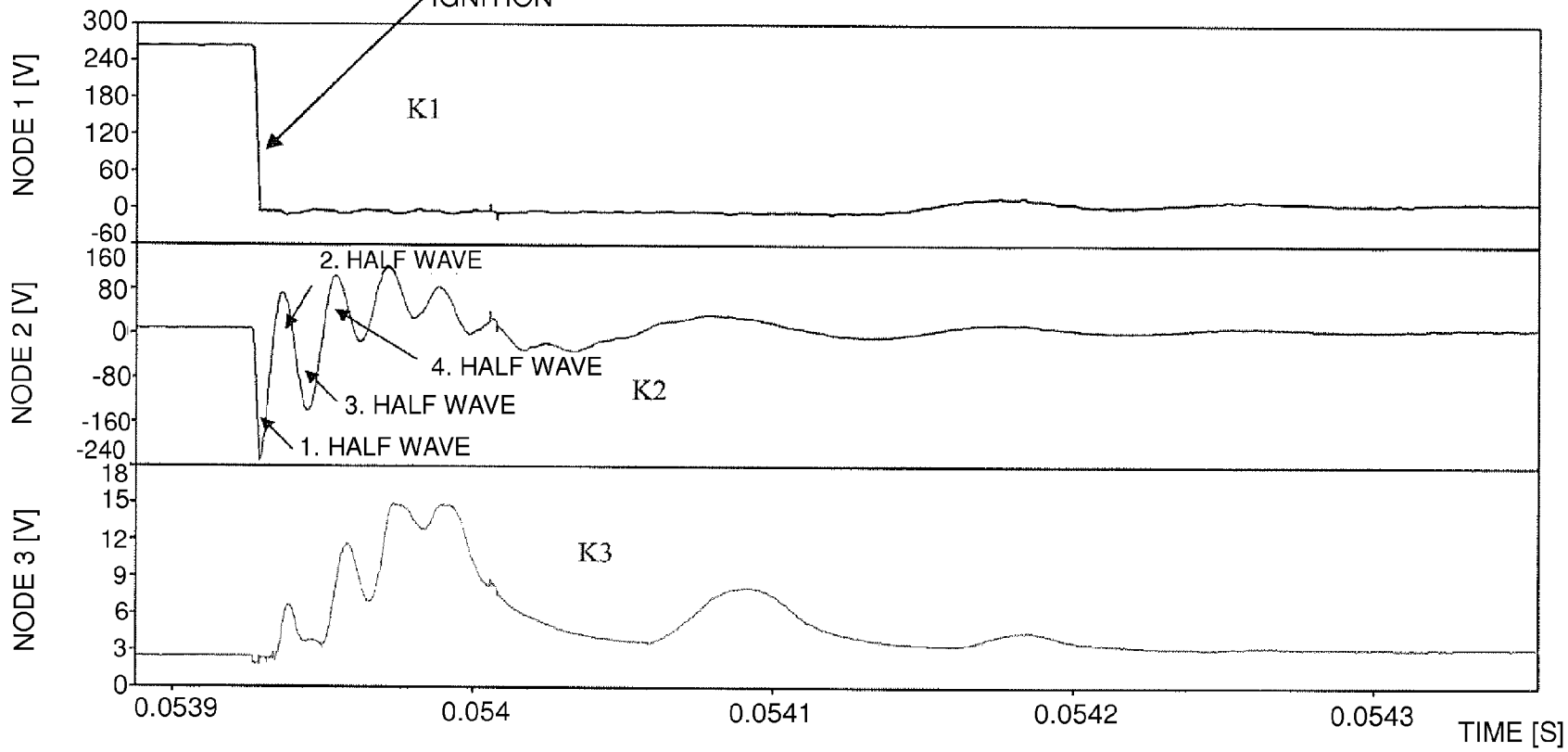

FIG. 5 shows a diagram of the voltage curves at the three nodes K1, K2 and K3 of the circuit 40 of FIG. 4. In this case, the voltage in volts is recorded on the ordinate, and the time in seconds is recorded on the abscissa.

The upper voltage curve for the node K1 is shown by the voltage curve on the side of the ignition capacitor 46 that faces the microcontroller 41. Below this, the voltage curve or voltage wave curve at node K2 is shown on the side of the ignition capacitor 46 that faces the stop connection 53.

The voltage curve at node K3 near the stop connection 53 is shown all the way at the bottom in the illustration of FIG. 5, wherein said voltage curve clearly indicates that only the evenly numbered half waves of the voltage wave series at node K2 are conducted in the direction of the stop connection 53 and used for burning off or cleaning.

Figure 6:
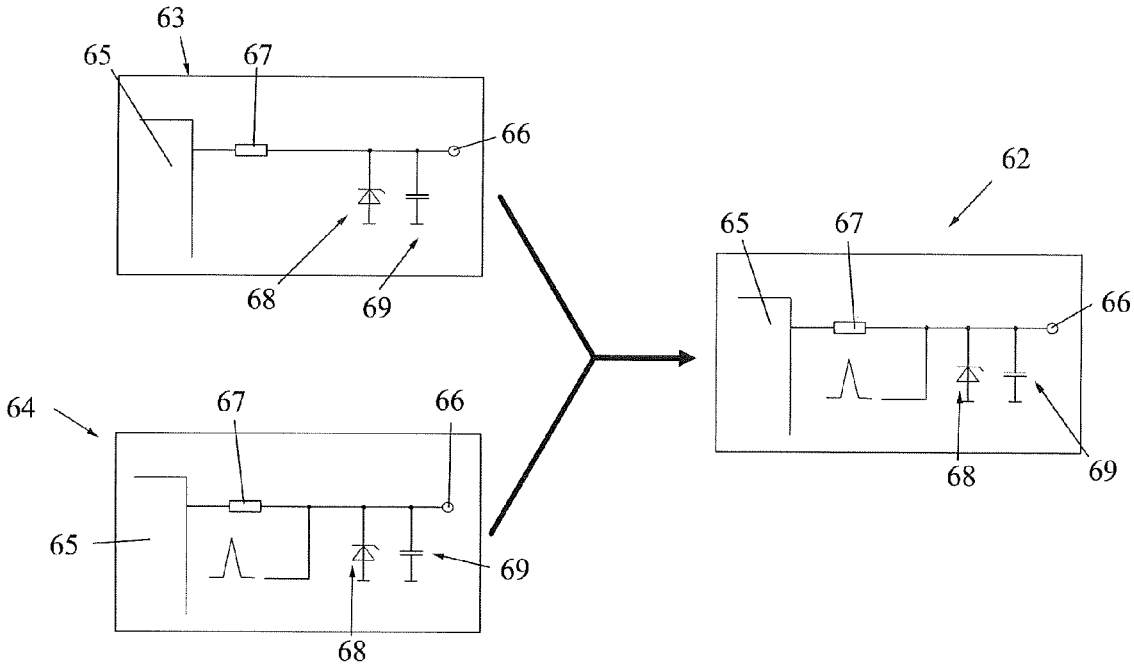

FIG. 6 shows a protective and limiting circuit 62 according to the invention, which involves a combined circuit comprising the circuits 63 (protective circuit) and 64 (medium voltage pulses). Components of this voltage limiter or the protective circuit between a microcontroller 65 and a stop connection 66 are a resistor 67, a Zener diode 68 and a capacitor 69. This can naturally involve the corresponding elements, for example, according to the circuit 40 of FIG. 4. However, an embodiment independent of the concrete circuit 40 of FIG. 4 is also conceivable.

As a result of the voltage limitation of the medium voltage stop, no voltage can build up that would be high enough to risk an electric shock. At the same time, this protective element represents the protective circuit of the stop input. Both with an internal and with an external voltage peak, the capacitor 69 must first be charged. Until it is fully charged, it is of relatively low resistance. The capacitor 69 can independently block lower voltage peaks. If the capacitor is no longer sufficient for blocking the voltage peaks, then the voltage will increase until the Zener diode 68 itself engages as a voltage limiter. The strength of the medium voltage pulse must be such that it is sufficient for fully charging the capacitor 69. If this were not the case, the voltage levels at the stop connection 66 would not reach the desired level. The capacitor 69 produces a positive effect on the burning off process because, if an oxide layer is present at the stop switch, the voltage at the capacitor 69 will increase until the oxide layer has been broken through and the flow of current can begin. In this, the capacitor 69 then empties and thereby supports the cleaning process. The already known protective circuit 63 is therefore combined with the circuit 64, which shows the parts necessary for an exemplary medium voltage stop. In the combined protective and limiting circuit 62, the Zener diode 68 and the capacitor 69 are used doubled. By combining the protective circuit and the limiting circuit 63, 64, a savings in components and costs is therefore realized. The cleaning pulses are advantageously coupled in such a way that already existing components (the protective circuit 63) are used for signal formation of the medium voltage burning off pulse according to the combined circuit 62. The voltage amplitude is limited by the Zener diode 68, which also performs the function of protecting the controller 62 against high disruptive pulses and/or of cutting off said controller. The capacitor 69, which also performs the task of protecting the controller 62 against high disruptive pulses, stores energy from the coupled-in medium voltage burning off pulse, and, during the burning off process, allows current to flow via the stop contact, in order to burn off said contact. It can be verified in the manner of a self-protection of the circuit 62.

Figure 7:
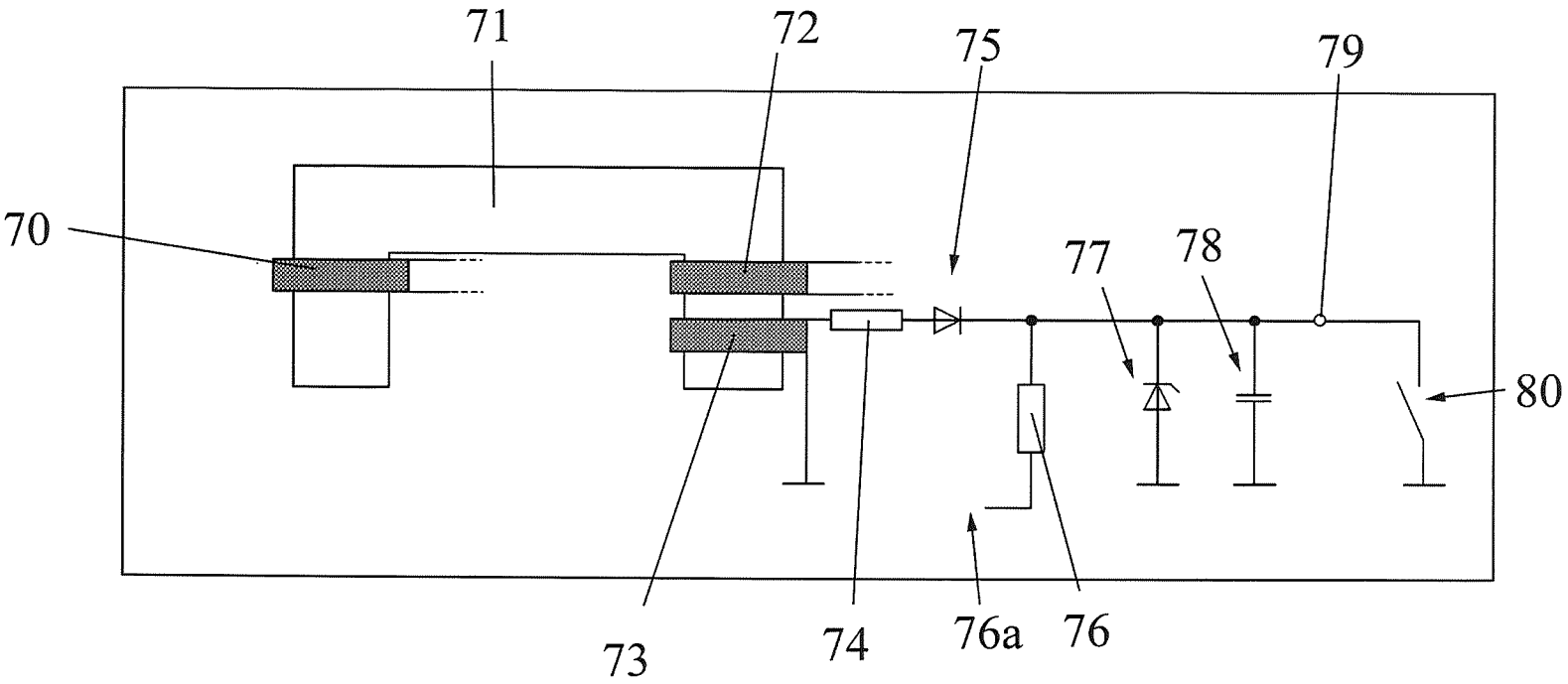
Figure 8:
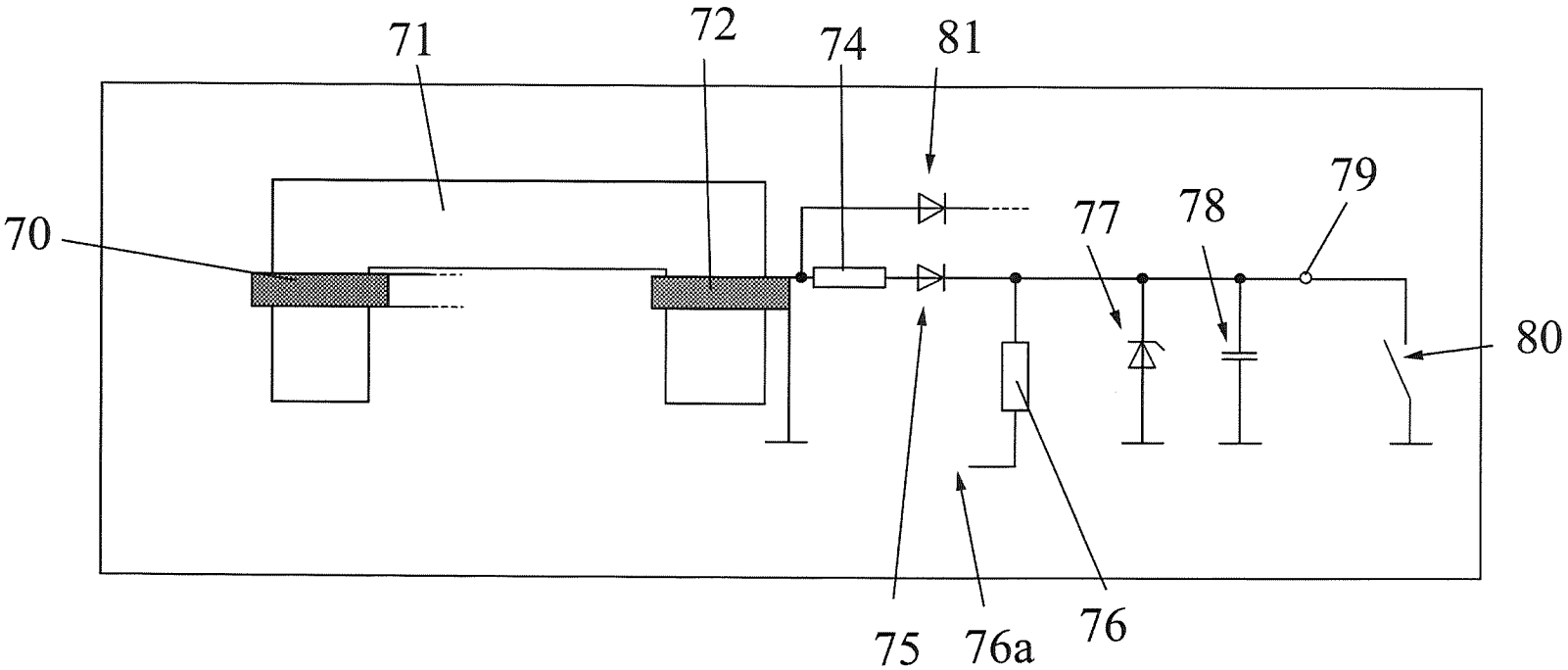

FIGS. 7 and 8 show diagrams outlining the principle of generating medium voltage pulses by means of coils. FIG. 7 shows a trigger coil 70 on a metal core 71. On the other side of the metal core 71, the charging coil 72 is situated. Also on said other side, a separate medium voltage coil 73 for generating the medium voltage pulses is also arranged. Said separate medium voltage coil 73 is absent in the arrangement of FIG. 8. There, the charging coil already present in the circuit is used for generating the medium voltage pulses.

In the case of FIG. 7 with the separate medium voltage coil 73, a resistor 74 is connected to said coil, followed by a diode 75 in the direction of the stop connection 79. Via a resistor 76, as also in the illustration of FIG. 8, a connection **76*a* to a stop pin of a microcontroller is produced, which pin is not shown here, for purposes of clarity. In the method and manner already described above, a Zener diode 77 and a capacitor 78, each with its respectively remote side grounded, are connected in parallel to the stop connection 79. The stop switch 80 assigned to the stop connection 79** is also shown.

FIG. 8, which shows the example of the combined coils, in other words, in which the charging coil 72 fulfills its function ordinarily provided for in the circuit as well as generating the medium voltage pulses, an additional diode 81 is arranged upstream of the resistor 74 and downstream of the charging coil 72, in parallel with the resistor 74, which diode does not produce the connection with the stop connection 79, but instead produces the connection with the target to be charged. Thus the charging coil 72 is able to fulfill two functions. In principle, of course, a different coil from the charging coil 72 can also be used as a combined coil (also) for generating medium voltage pulses.

Figure 9:
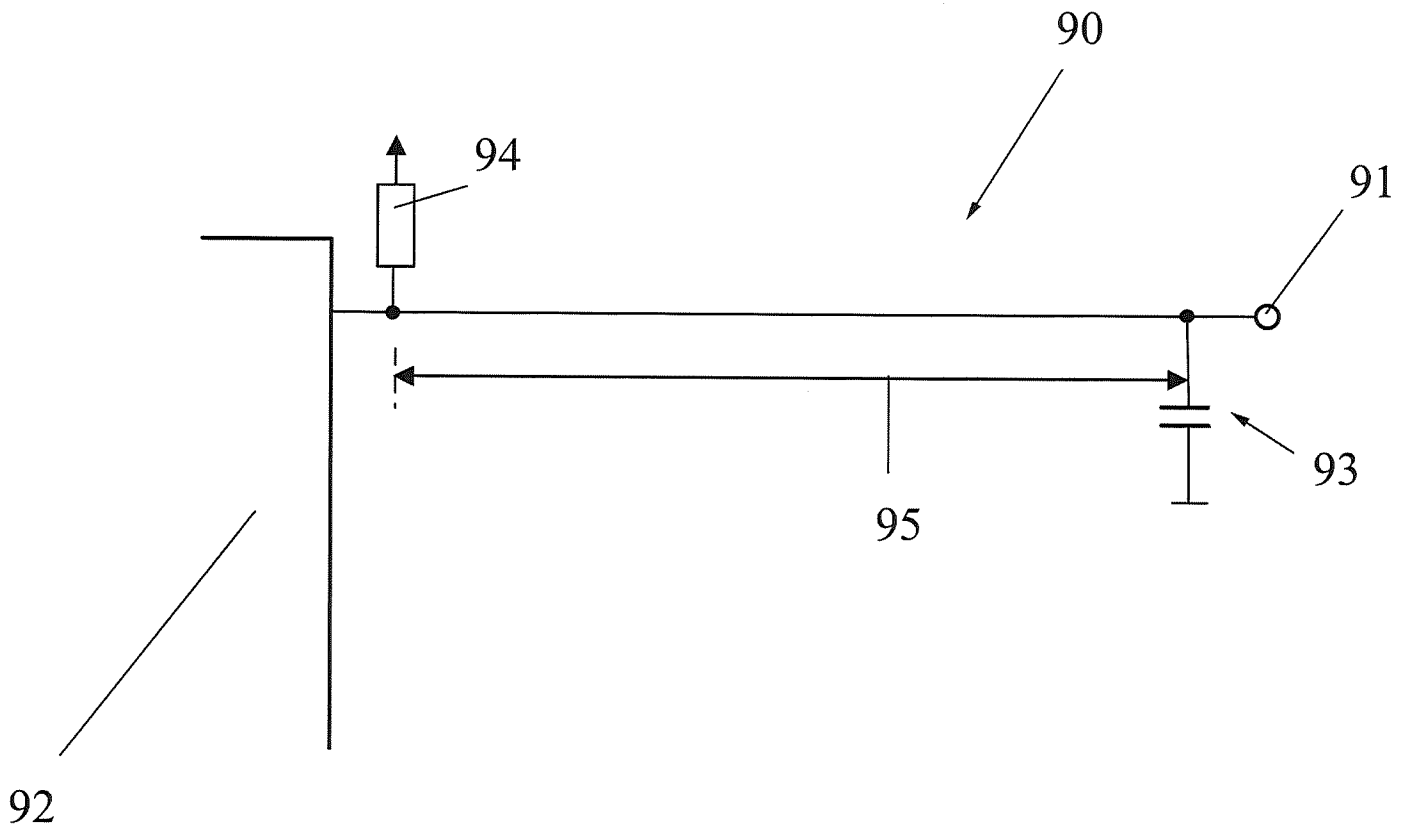

FIG. 9 shows a self-protecting structure 90 of a digital circuit according to the invention with a stop connection 91 and a microcontroller 92. A capacitor 93 is parallel connected to the stop connection 91, with its side that faces away from said connection being grounded. As is shown here, the capacitor 93 is provided as close as possible to the stop connection 91 or to an external connection of the circuit. In contrast, the resistor 94, which in this case is a pull-up resistor, is provided as close as possible to the microcontroller 92. The resistor at the microcontroller 92 can also optionally be an internal resistor of the microcontroller 92. The path protected in this manner by means of the self-protecting structure is identified in the illustration of FIG. 9 by reference sign 95.

Figure 10:
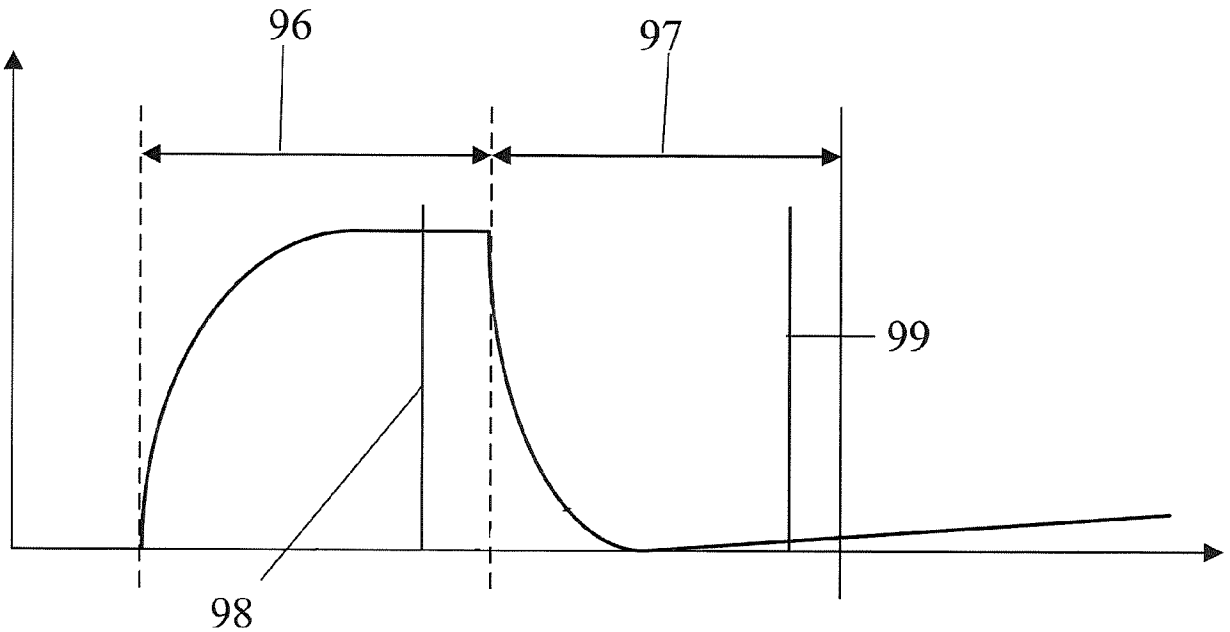

To verify the connection between the resistor 94 and the capacitor 93, two processes are required, which in FIG. 10 are shown as protection phases in the self-protecting structure 90 of FIG. 9. In phase 1, which in FIG. 10 is assigned reference sign 96, the capacitor 93 is charged for a certain period of time and is then read out again. In this case, the microcontroller 92 should read a high level. If this is not the case, either the external stop switch is pressed, or the igniter of an ignition circuit has an internal connection with the ground. In either case, no ignition spark is generated and/or a different circuit function is not implemented, and therefore a differentiation between the cases is not necessary.

If, as expected, a high is read in phase 1, the transition to phase 2 with the reference sign 97 takes place. The capacitor 93 is discharged and then read in again. The microcontroller should then detect a low level. If this is not the case, there are again several possible causes, such as an interruption inside the igniter between the resistor 94 and the capacitor 93, a missing capacitor 93, an end to the supply voltage, etc. These cases also need not be further differentiated, as in the case of an ignition circuit, all result in a shut-off of the ignition spark.

The vertical lines 98 and 99, for example, identify points on the voltage curve or times for measurement of the levels in the self-protecting structure 90.

The pull-up resistor 94 of the self-protecting structure 90 is necessary for detecting the absence of the capacitor 93, because the input of the microcontroller 92 also has a low capacity. The resistor 94 pulls the input of the microcontroller 92 to a high level when the capacitor 93 is absent, and should be embodied as high-resistance as possible for energy saving purposes. The resistor 94 may not charge the capacitor 93 at the stop connection 91 too rapidly. For the flexible detection of high and low levels or states, a microcontroller 92 with analog/digital converters or with a comparator can be used. The stop switch can be sensed in the same way as in phase 1 in accordance with reference sign 96 of the protection of the connection paths in the self-protecting structure 90. These two functions can thus be combined, so that then a stop switch sensing in the case of a digital circuit with a self-protecting structure would be a part of the self-protecting structure or the protection.

Figure 11:
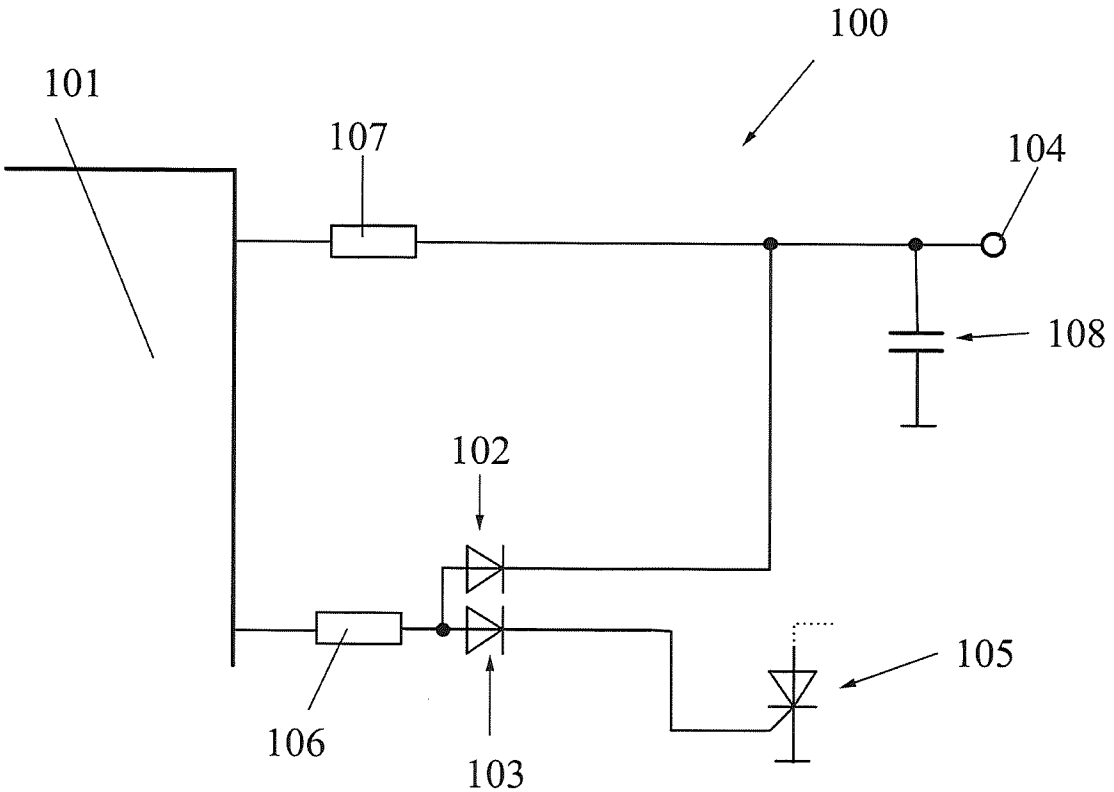

FIG. 11 shows a diagram outlining the principle of a hardware reach-through 100 according to the invention, with which, for example, in the case of an ignition circuit, it can be ensured that the igniter will not generate a spark when the stop switch is connected, even if a microcontroller 101 intends to produce a spark. As is shown here, this can be achieved by the additional diodes 102 and 103. If the stop switch assigned to the stop connection 104 is not pressed, the thyristor 105 is connected through by a high level of the ignition output. An ignition spark is thereby produced.

If the stop switch is pressed, the stop connection 104 is grounded. With the diode 102, no greater voltage than, in this example, approximately 0.7 volts is able to build up between the resistor 106 and the diode 103. However, this voltage is basically lost via the diode 103, and therefore no voltage is able to build up at the gate input of the thyristor 105, and the thyristor is never connected through, and thus no ignition spark is generated. In addition, as was already explained in connection, for example, with the self-protecting structure of FIGS. 9 and 10, in the case of the hardware reach-through 100 for self-protecting the connection of the microcontroller 101 and the stop connection 104, a resistor 107 is provided close to the microcontroller 101 and a capacitor 108 is provided close to the stop connection 104. Of course, it is also possible, however, to provide the hardware reach-through 100 independently of a self-protecting structure, or independently of a medium voltage stop in digital circuits. With a combination of these elements with a medium voltage stop, however, an optimal circuit and component protection can be achieved with particular advantage.

LIST OF REFERENCE SIGNS

1 Switching circuit
2 Charging coil
3 Breaker coil
3*b* Coil
4 Metal core
5 Trigger coil
6 Thyristor
7 Stop switch
8 Resistor
9 Capacitor
10 Diode
11 Magnetic ignition circuit
12 Voltage source
13 Diode
14 Ignition capacitor
15 Switch
16 Primary coil
17 Secondary coil
18 Stop connection
19 Ignition coil
20 High voltage
21 Diode
21*b* Resistor
22 Voltage wave series
23 Ordinate
24 Abscissa
31 Half wave
32 Half wave
33 Half wave
34 Half wave
35 Half wave
36 Half wave
25 Line
40 Magnetic ignition circuit
41 Microcontroller
42 Stop pin
43 Ignition output
44 Voltage source
45 Diode
46 Ignition capacitor
47 Thyristor
K1 Node
48 Primary coil
48 Ignition coil arrangement
50 Secondary coil
51 High voltage secondary coil
K2 Node
52 Diode
53 Stop connection
54 Resistor
55 Capacitor
57 Diode
58 Diode
59 Decoupling resistor
60 Resistor
K3 Node
61 Zener diode
62 Protecting and limiting circuit
63 Circuit
64 Circuit
65 Microcontroller
66 Stop connection
67 Resistor
68 Zener diode
69 Capacitor
70 Trigger coil
71 Metal core
72 Charging coil
73 Medium voltage coil
74 Resistor
75 Diode
76 Resistor
76*a* Stop pin connection
77 Zener diode
78 Capacitor
79 Stop connection
80 Stop switch
81 Diode
90 Self-protecting construction
91 Stop connection
92 Microcontroller

93 Capacitor
94 Resistor
95 Protected path
96 Phase 1
97 Phase
98 Line
99 Line
100 Hardware reach-through
101 Microcontroller
102 Diode
103 Diode
104 Stop connection
105 Thyristor
106 Resistor
107 Resistor
108 Capacitor

The invention claimed is:

1. A manually operable device with a combustion engine, comprising a digitally controlled magnetic ignition circuit (11, 40) comprising a stop connection (18, 53, 66, 79, 91, 104) assigned to a stop switch (80), wherein the magnetic ignition circuit (11, 40) is embodied for generating and applying at least one voltage pulse, which provides a cleaning effect for the stop switch (80), to the stop connection (18, 53, 66, 79, 91, 104), and wherein the magnetic ignition circuit (11, 40) is embodied for generating a voltage wave series (22) from half waves (31-36) having a temporally decreasing amplitude, or for generating at least one voltage pulse in a medium voltage range of 12 V to 50 V, characterized in that, if a voltage wave series (22) having a temporally decreasing amplitude is generated, the magnetic ignition circuit (11, 40) is embodied for applying at least one later half wave (32-36) in the voltage wave series (32), which half wave follows the first half wave (31) temporally and therefore has a lower amplitude, as a voltage pulse to the stop connection (18, 53, 66, 79, 91, 104), or in that, if at least one voltage pulse in a medium voltage range of 12 V to 50 V is generated, the magnetic ignition circuit (11, 40) is embodied for applying the one or more voltage pulses to the stop connection (18, 53, 66, 79, 91, 104), and thereby exerts a cleaning effect on the stop switch (80).

2. A digitally controlled magnetic ignition circuit (11, 40) of an electrical device comprising a stop connection (18, 53, 66, 79, 91, 104) assigned to a stop circuit (80), wherein the magnetic ignition circuit (11, 40) is embodied for generating and applying at least one voltage pulse, which provides a cleaning effect for the stop switch (80), to the stop connection (18, 53, 66, 79, 91, 104), and wherein the magnetic ignition circuit (11, 40) is embodied for generating a voltage wave series (22) from half waves (31-36), the amplitude of which decreases over time, or for generating at least one voltage pulse in a medium voltage range of 12 V to 50 V, characterized in that, if a voltage wave series (22) having a temporally decreasing amplitude is generated, the magnetic ignition circuit (11, 40) is embodied for applying at least one half wave (32-36) in the voltage wave series (32), said half wave following the first half wave (31) temporally and therefore having a lower amplitude, as a voltage pulse to the stop connection (18, 53, 66, 79, 91, 104), or in that if at least one voltage pulse in a medium voltage range of 12 V to 50 V is generated, the magnetic ignition circuit (11, 40) is embodied for applying the one or more voltage pulses to the stop connection (18, 53, 66, 79, 91, 104), and thereby exerts a cleaning effect on the stop switch (80).

3. The digitally controlled magnetic ignition circuit (11, 40) according to claim 2, characterized in that the magnetic ignition circuit (11, 40) is embodied for applying at least one half wave of an ignition voltage wave series (22) generated on the part of the magnetic ignition circuit (11, 40), or for applying at least one ignition voltage pulse generated on the part of the magnetic ignition circuit (11, 40) to the stop connection (18, 53, 66, 79, 91, 104) for the purpose of cleaning, or in that the magnetic ignition circuit (11, 40) is embodied for generating a voltage wave series (22) originating from a high voltage and having a temporally decreasing amplitude, or in that the stop connection (18, 53, 66, 79, 91, 104) is embodied for shutting off an ignition spark.

4. The digitally controlled magnetic ignition circuit (11, 40) according to claim 3, characterized in that the magnetic ignition circuit (11, 40) is embodied for applying every other half wave (32, 34, 36) in the voltage wave series (22) or only medium voltage pulses (32-36) or half waves (32-36) in the voltage wave series (22) that do not lead to an electric shock or voltage pulses that do not lead to an electric shock to the stop connection (18, 53, 66, 79, 91, 104), or in that at least one half wave (32-36) applied to the stop connection (18, 53, 66, 79, 91, 104) or at least one applied voltage pulse are embodied for cleaning the stop connection (18, 53, 66, 79, 91, 104) by breaking through or destroying an undesirable oxide layer.

5. The digitally controlled magnetic ignition circuit (11, 40) according to claim 4, characterized in that a component that conducts current in only one direction is connected upstream of the stop connection (18, 53, 66, 79, 91, 104) in such a way that only certain half waves (32-36) or voltage pulses are applied to the stop connection (18, 53, 66, 79, 91, 104), or in that a resistor (21*b*, 54) is connected upstream of the stop connection (18, 53, 66, 79, 91, 104), via which resistor the voltage of the at least one half wave (32-36) to be applied to the stop connection (18, 53, 66, 79, 91, 104) or of the at least one voltage pulse can be adjusted, or in that the voltage at the stop connection (18, 53, 66, 79, 91, 104) can be limited by means of a voltage limiter.

6. The digitally controlled magnetic ignition circuit (11, 40) according to claim 5, characterized in that the proper connection between a pin (42, 43) of a microcontroller (41, 65, 92, 101), which controls the magnetic ignition circuit (11), and the stop connection (18, 53, 66, 79, 91, 104) can be verified by means of a capacitor (55, 69, 78, 93, 108) close to the stop connection (18, 53, 66, 79, 91, 104) and a resistor (60, 67, 94, 107) close to the microcontroller (41, 65, 92, 101).

7. The digitally controlled magnetic ignition circuit (11, 40) according to claim 6, characterized in that a hardware reach-through (100), comprising at least one diode (57, 58, 102, 103), ensures that when the stop switch (80) is connected, no ignition spark (41, 65, 92, 101) can be generated, regardless of the actuation of the magnetic ignition circuit (11, 40) by a microcontroller.

8. The digitally controlled magnetic ignition circuit (11, 40) according to claim 7, characterized in that the magnetic ignition circuit (11, 40) comprises a coil (16, 48, 72, 73) having a metal core (71) or iron core, or a coil (16, 48, 72, 73) through which a magnetic field of a magnetic flywheel passes, or the primary side of an ignition coil (19, 49), for generating the voltage wave series (22) or for generating the at least one voltage pulse.

9. A method for generating and applying at least one voltage pulse, which provides a cleaning effect for a stop switch (80), to a stop connection (18, 53, 66, 79, 91, 104) assigned to the stop switch (80), said stop connection being provided on a digitally controlled magnetic ignition circuit (11, 40) of an electrical device, wherein the magnetic ignition circuit (11, 40) generates a voltage wave series (22) from half waves (31-36), the amplitude of which decreases over time, or generates at least one voltage pulse in a medium voltage range, characterized in that if a voltage wave series (22) is generated, at least one later half wave (32-36) in the voltage wave series, said half wave following the first half wave (31) in time and therefore having a lower amplitude, is applied as a voltage pulse to the stop connection, or in that if at least one voltage pulse in a medium voltage range of 12 V to 50 V is generated, the one or more voltage pulses are applied to the stop connection (18, 53, 66, 79, 91, 104), thereby exerting a cleaning effect on the stop switch (80).

10. The method of claim 9, characterized in that at least one half wave of an ignition voltage wave series (22) generated on the part of the magnetic ignition circuit (11, 40) or at least one ignition voltage pulse generated on the part of the magnetic ignition circuit (11, 40) are applied to the stop connection (18, 53, 66, 79, 91, 104) for cleaning, or in that a voltage wave series (22) originating from a high voltage is generated as the voltage wave series (22) having a temporally decreasing amplitude, or in that an ignition spark is shut off as needed by means of the stop connection (18, 53, 66, 79, 91, 104).

11. The method according to claim 10, characterized in that every second half wave (32, 34, 36) in the voltage wave series (32) or only medium voltage pulses (32, 34, 36) or half waves (32-36) in the voltage wave series that do not lead to an electric shock or voltage pulses that do not lead to an electric shock are applied to the stop connection (18, 53, 66, 79, 91, 104) or in that at least one half wave (32-36) applied to the stop connection (18, 53, 66, 79, 91, 104) or at least one applied voltage pulse exert a cleaning effect on the stop connection (18), in that an undesirable oxide layer is broken through or destroyed.

12. The method according to claim 11, characterized in that a component which conducts current in only one direction, is connected upstream of the stop connection (18, 53, 66, 79, 91, 104) in such a way that only certain half waves (32-36) or voltage pulses are applied to the stop connection (18, 53, 66, 79, 91, 104), or in that by means of a resistor (21*b*, 54) connected upstream of the stop connection (18, 53, 66, 79, 91, 104), the voltage of the at least one half wave (32-36) to be applied to the stop connection (18, 53, 66, 79, 91, 104) or the voltage of the at least one voltage pulse are adjusted.

13. The method according to claim 12, characterized in that the voltage at the stop connection (18, 53, 66, 79, 91, 104) is limited by means of a voltage limiter, or in that a protective circuit of at least one pin of a microcontroller (41, 65, 92, 101) that controls the magnetic ignition circuit (11, 40) is realized.

14. The method according to claim 13, characterized in that the proper connection between a pin (42, 43) of a microcontroller (41, 65, 92, 101) that controls the magnetic ignition circuit (11) and the stop connection (18, 53, 66, 79, 91, 104) is verified by means of a self-protecting structural design (90) with a capacitor (55, 69, 78, 93, 108) close to the stop connection and a resistor (60, 67, 94, 107) close to the microcontroller (41, 65, 92, 101).

15. The method according to claim 14, characterized in that a hardware reach-through (100) implemented by means of at least one diode (57, 58, 102, 103), ensures that when the stop switch (80) is connected, no ignition spark is generated, independently of the controlling of the magnetic ignition circuit (11, 40) by a microcontroller (41, 65, 92, 101).

16. The method according to claim 15, characterized in that the voltage wave series (22) or the at least one voltage pulse are generated by a coil (16, 48, 72, 73) with a metal core (71) or iron core or a coil (16, 48, 72, 73) through which a magnetic field of a magnetic flywheel passes or the primary side of an ignition coil (19, 49).

* * * * *